United States Patent [19]

Sutter

[11] 4,091,507

[45] May 30, 1978

[54] MOUNTING APPARATUS FOR A TEXTILE MACHINE, ESPECIALLY A CARD

[75] Inventor: Hanspeter Sutter, Uster, Switzerland

[73] Assignee: Luwa AG, Zurich, Switzerland

[21] Appl. No.: 727,763

[22] Filed: Sep. 29, 1976

[30] Foreign Application Priority Data

Oct. 4, 1975 Switzerland ..... 12851/75

[51] Int. Cl.[2] ..... D01G 15/82

[52] U.S. Cl. ..... 19/107

[58] Field of Search ..... 19/107, 98; 55/419, 55/467; 15/346

[56] References Cited

U.S. PATENT DOCUMENTS 3,150,415 9/1964 Reiterer ..... 19/107

3,486,309 12/1969 Wild ..... 19/107 X 3,987,517 10/1976 Bonalumi ..... 19/107

*Primary Examiner*—Dorsey Newton

*Attorney, Agent, or Firm*—Werner W. Kleeman

[57] ABSTRACT

A mounting apparatus for a textile machine, especially a card, comprising support means maintaining a spacing between the textile machine and a foundation and a pneumatic cleaning device having blow- and suction openings arranged at least beneath the textile machine, and air channels blow communicating with pressure- and suction connections. The air channels which are constructed with respect to their flow properties or characteristics independent of the support means, are arranged in hollow spaces of the support means.

2 Claims, 4 Drawing Figures

Fig.1
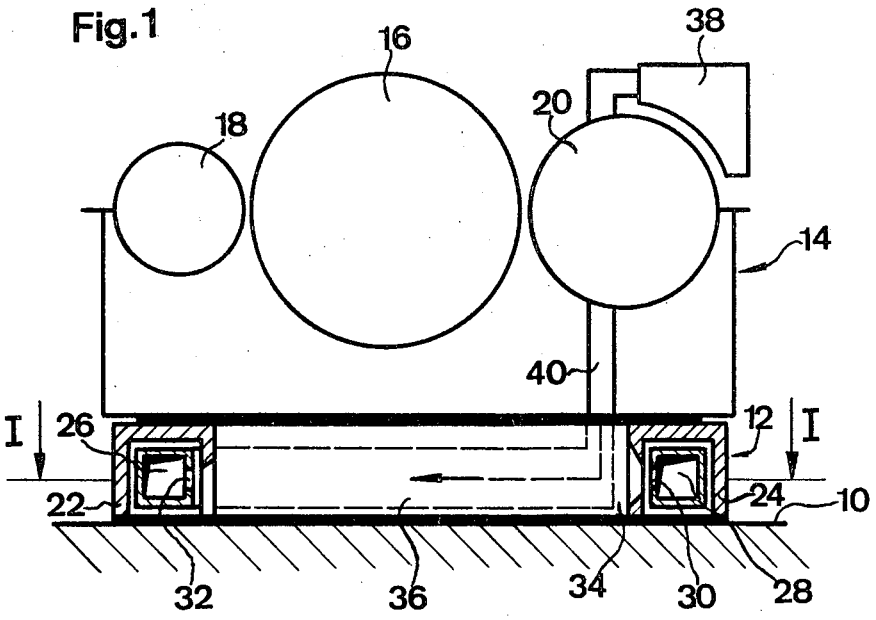
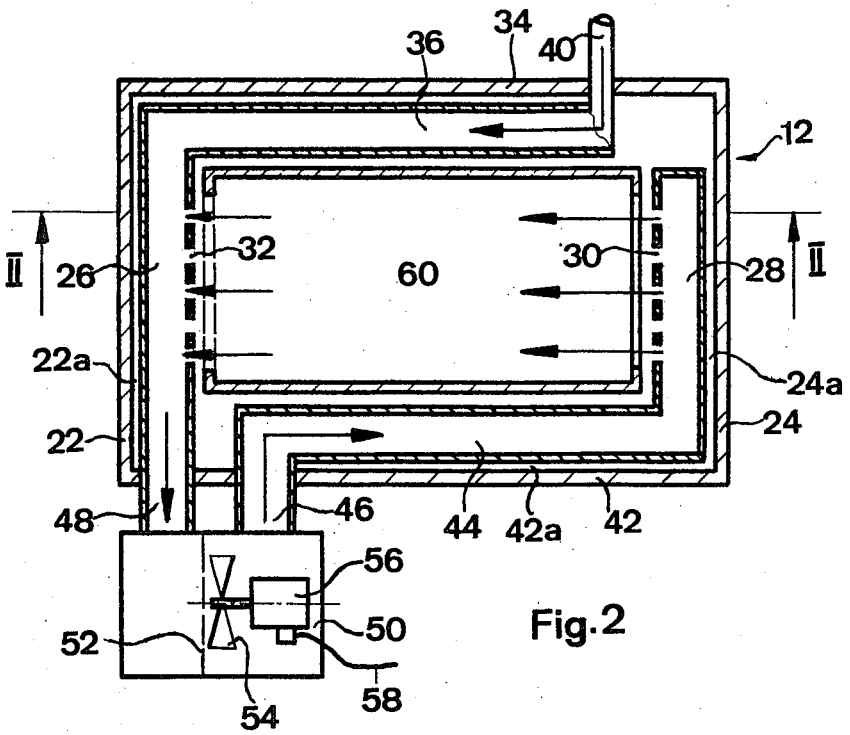
Fig.2

MOUNTING APPARATUS FOR A TEXTILE MACHINE, ESPECIALLY A CARD

BACKGROUND OF THE INVENTION

The present invention relates to a new and improved construction of a mounting apparatus for a textile machine, especially a carding machine or card, comprising support means maintaining a spacing between the textile machine and a foundation and a pneumatic cleaning device having blower- and suction openings arranged at least beneath the textile machine, the cleaning device being connected by air channels with pressure- and suction connections.

Such cleaning devices serve for the removal of dust formed during the processing of textile fibers from the region of the textile machine, in order to directly act upon the dust at the source of its formation and to prevent any contamination of the air which would be harmful to the health of individuals.

According to a state-of-the-art mounting apparatus of this type the air channels are arranged laterally at the textile machine, rendering access to the machine more difficult and requiring a corresponding amount of space adjacent such machine.

SUMMARY OF THE INVENTION

Therefore, with the foregoing in mind, it is a primary object of the present invention to provide a new and improved construction of mounting apparatus for a textile machine, especially although not solely a card, which is not associated with the aforementioned drawbacks and limitations of the prior art proposals.

Another and more specific object of the present invention is concerned with constructing a mounting apparatus for a textile machine in such a manner that the air channels do not hinder the accessibility to the machine and do not require any additional space.

Now in order to implement these and still further objects of the invention, which will become more readily apparent as the description proceeds, the invention contemplates that the air channels formed with respect to their flow characteristics or properties independently of the support means are arranged in hollow spaces of the support means.

There is already known to the art an arrangement wherein profile irons or structural sections, forming the support means and raising the machine from the floor, are used as air channels. Such arrangement is, however, associated with a decisive drawback, because the profile irons or structural sections serving normally as the support or as other mechanical connection elements, exhibit a surface having a certain roughness at which there adhere the fine textile fibers. Thus, such air channels are easily contaminated and must be frequently cleaned. Apart from this requiring an additional expenditure in work there also are present undesired downtimes of the machine. A further drawback resides in the need for sealing the relatively heavy profile irons at all joints at the region thereof serving as the air channel.

The subject matter of the present invention is advantageous in contrast to the above prior art constructions in that it combines the advantages of air channels constructed independent of the support means with those which do not require any additional space adjacent the machine. The air channels thus can be formed from a material which is particularly suitable for the purposes of fulfilling the objects of the invention, namely formed of a material having a smooth surface, such as for example sheet metal or PVC. The arrangement of the air channels in the hollow spaces of the support means additionally renders it possible to manufacture a compact pre-fabricated mounting unit which can be erected with very little work at the erection site.

According to an advantageous constructional embodiment of the invention the air channels can be constructed by profile-like or structural-like elements located in a plane, these elements piercing the support means in their lengthwise directions. In this way the air channels are protected against damage.

The air channels also can enclose in an approximately frame-like manner the base surface or outline of the machine. This configuration affords the advantage that the dust to be eliminated, can be retained at the region of the machine, until it is sucked-off. Also, the support means can be in the form of a support or carrier frame at least partially consisting of the hollow profile elements.

A further construction of the invention entails designing at least a respective region of the air channels as air distributor- and collecting chambers and possessing the blow- and suction openings. Such physical manifestation of the invention is advantageous by virtue of the possibility of eliminating separate chambers for this purpose, and also there can be dispensed with separate branch conduits or branches for such purpose.

Additionally, there can be attained a rational and economical construction inasmuch as the air channels for more than one machine, for instance, for two machines, can be assembled together into a unit having common pressure- and suction connections.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic longitudinal sectional view, taken substantially along the line II — II of FIG. 2, of a card equipped with a mounting unit or apparatus designed according to the invention;

FIG. 2 is a horizontal sectional view through a mounting unit, taken substantially along the line I — I of FIG. 1, and possessing a support or carrier frame equipped with air channels arranged in its hollow spaces or compartments;

DETAILED DESCRIPTION OF THE PREFERRED EMBODIMENTS

Figure 4:
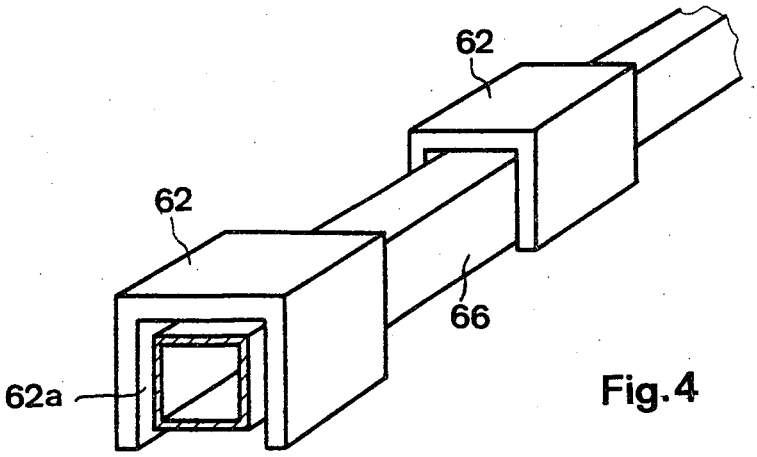
FIG. 4 is a crosss-sectional view through an air channel arranged in hollow spaces of the support elements.

Describing now the drawings, in FIG. 1 there is illustrated a support means arranged upon a foundation or base 10 and constructed as a support or carrier frame 12. Mounted upon the support means is a textile machine 14, for instance a card having a card drum or roller 16, a licker-in roll 18 and a take-off roll 20. The support frame 12 embodies support elements 22, 24 which in cross-section, in the exemplary embodiment, possess a subtantially U-shape. These support elements 22, 24 form transverse supports of the support frame 12. In the hollow spaces or compartments 22a, 24a of the support elements 22, 24 respectively, there are arranged or interfitted the air channel sections or conduits 26, 28 respectively. These air channel sections possess blow or blower openings 30 and suction openings 32 which are located opposite one another in the lengthwise direction of the support frame 12. In a lengthwise support 34 there is arranged a further air channel section 36 which has been shown in broken lines in FIG. 1. The horizontally situated air channel section 36 merges with a vertically arranged air conduit or pipe 40 leading to a cover or cover member 38. This cover member 38 is disposed above the take-off roll 20.

The showing of FIG. 2, which constitutes a cross-section along the line I — I of FIG. 1, contains a number of the reference characters which have been considered with regard to the description of FIG. 1. The lengthwise support 34 has situated opposite thereto a second lengthwise support 42, in the hollow space or chamber 42a of which there is arranged an air channel section or conduit 44 which connects a pressure connection 46 with the air channel section 28 located in the transverse support 24. A suction connection 48 is connected with the air channel section 26, at which there is connected the air channel section 36 and the air conduit or pipe 40. The pressure connection 46 and the suction connection 48 open into a cabinet or box 50, in which there are located the schematically illustrated air filter 52 and blower 54. The blower 52 is driven by any suitable electric motor 56 which is powered by electrical current infed via the connection cable 58. The arrows, which have not been particularly referenced in FIG. 2, designate the direction of air flow when the blower 54 is in operation.

Based upon a description of the function there will be explained more fully hereinafter the mode of operation of the described arrangement. With the blower 54 in operation such generates an air flow which propagates through the pressure connection 46, the air channel sections 44, 28 and the blower or blow openings 30. The air is blown through the blow openings 30 in the direction of the arrows over a surface or area 60, at which there is entrained the dust formed during processing of the textile fibers, and delivered to the suction openings 32. The dust, sucked-up by the blower 54 through the suction openings 32, arrives by means of the air channel section 26 and the suction connection 48 in the cabinet or box 50 where it is held back by the air filter 52. The filtered air flows in a closed cycle again through the pressure connection 46 and through the system in the manner already described. Further, dust formed beneath the cover member 38 at the take-off roll 20 is sucked-up and conducted through the air conduit 40 as well as through the air channels 36, 26 to the air filter 52.

Figure 3:
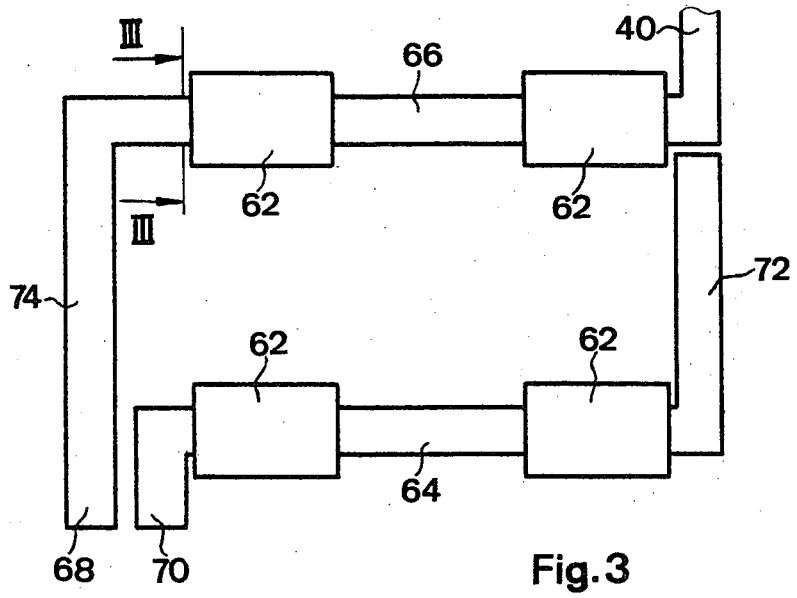
FIG. 3 is a plan view of a mounting unit or apparatus of the invention according to a modified construction and possessing support elements and air channels arranged in their hollow spaces.

FIG. 3 illustrates a modified arrangement which comprises a support means possessing four support elements 62 and air channels 64, 66 arranged or interfitted in the hollow spaces 62a of the support elements 62. These air channels 64, 66 are connected with the suction- and pressure connections 68, 70. The air channel sections 72, 74 which are located opposite one another in the lengthwise direction of the arrangement are designed as air distributor- and collecting chambers respectively, and, in the same manner as already described with regard to the arrangement of FIG. 2, possess blow- and suction openings. The air channel section 66 leads to a vertically arranged air conduit or pipe 40, just as previously described for the system of FIGS. 1 and 2.

FIG. 4 illustrates a manner in which an air channel, for instance the section 66, is arranged or interfitted in the hollow spaces 62a of the support elements 62, the showing being a sectional view along the line III — III of FIG. 3.

The support means advantageously consisting of hollow profile or structural elements can possess, apart from the structural forms shown in FIGS. 2 and 3, also other random shapes. When it is advantageous for the support of the machine, the ends of the lengthwise supports 34, 42 (FIG. 2) can also protrude past the transverse supports 22, 24.

Starting with the embodiment of FIG. 3 it is also possible to provide a different number and/or a different arrangement of support elements 62. As the hollow profile elements there are suitable, apart from the illustrated U-shaped profiles, profile members possessing a different cross-sectional shape, for instance quadratic or square tubes. The air channels, as illustrated, can be square or also round. Instead of providing rigid air channels there could also be employed flexible air conduits. The air channels can also be assembled together into a unit for more than one machine and can then, for instance, be connected with a single blower and a single air filter.

While there are shown and described present preferred embodiments of the invention, it is to be distinctly understood that the invention is not limited thereto, but may be otherwise variously embodied and practiced within the scope of the following claims.

What is claimed is:

1. A mounting apparatus for a textile machine, in particular a carding machine, comprising support means for maintaining the textile machine in spaced relationship from a foundation supporting the textile machine, a pneumatic cleaning device having blow- and suction openings arranged at least beneath the textile machine, a pressure connection and suction connection, air channels separate from said support means and communicating with the pressure connection and suction connection, said support means having hollow spaces, the air channels being constructed with respect to their flow characteristics independent of the support means and being interfittingly arranged in the hollow spaces of said support means, said air channels comprising profile-like elements located in a plane, said profile-like elements piercingly extending through said support means in the lengthwise direction thereof, and said air channels enclose in an approximately frame-like manner the outline of the textile machine, said support means comprising spaced apart hollow profile elements arranged at predetermined locations along said air channels and straddling said air channels, said spaced apart hollow profile elements providing means for allowing air to escape from the hollow spaces of the support means.

2. The mounting apparatus as defined in claim 1, wherein said profile elements are of substantially U-shaped configuration.

* * * * *